US011395381B2

(12) United States Patent
Kubo et al.

(10) Patent No.: US 11,395,381 B2
(45) Date of Patent: Jul. 19, 2022

(54) ELECTROMAGNETIC FIELD DISTRIBUTION ADJUSTMENT DEVICE AND MICROWAVE HEATING DEVICE

(71) Applicant: Panasonic Corporation, Osaka (JP)

(72) Inventors: Masayuki Kubo, Shiga (JP); Koji Yoshino, Shiga (JP); Masafumi Sadahira, Shiga (JP); Osamu Hashimoto, Tokyo (JP); Ryosuke Suga, Kanagawa (JP)

(73) Assignee: PANASONIC HOLDINGS CORPORATION, Osaka (JP)

( * ) Notice: Subject to any disclaimer, the term of this patent is extended or adjusted under 35 U.S.C. 154(b) by 443 days.

(21) Appl. No.: 16/472,946

(22) PCT Filed: Dec. 25, 2017

(86) PCT No.: PCT/JP2017/046287

§ 371 (c)(1),
(2) Date: Jun. 24, 2019

(87) PCT Pub. No.: WO2018/131440

PCT Pub. Date: Jul. 19, 2018

(65) Prior Publication Data

US 2019/0364623 A1 Nov. 28, 2019

(30) Foreign Application Priority Data

Jan. 10, 2017 (JP) ..... JP2017-001554

(51) Int. Cl.
*H05B 6/68* (2006.01)
*H05B 6/70* (2006.01)

(52) U.S. Cl.
CPC ..... *H05B 6/687* (2013.01); *H05B 6/707* (2013.01)

(58) Field of Classification Search
CPC ..... H05B 6/6402; H05B 6/687; H05B 6/705; H05B 6/707; H05B 6/6408; H05B 6/6414; H05B 6/74; Y02B 40/00
(Continued)

(56) References Cited

U.S. PATENT DOCUMENTS

2009/0109121 A1 4/2009 Herz et al.
2010/0039343 A1* 2/2010 Uno ..... H01Q 3/24 343/818
2013/0048880 A1* 2/2013 Einziger ..... H05B 6/686 250/492.1

FOREIGN PATENT DOCUMENTS

CN 103367920 10/2013
CN 104319468 1/2015
(Continued)

OTHER PUBLICATIONS

International Search Report of PCT application No. PCT/JP2017/046287 dated Mar. 20, 2018.
Takahiro Hirose et al., "Stirring Experiment of Electromagnetic Filed in Microwave Oven Chamber Using Planar Electromagnetic Field Stirrer", Conference Proceedings: 2016-10026-260, The 2016 IEICE General Conference, C-15-10, Mar. 1, 2016 (With Full English Translation).
(Continued)

*Primary Examiner* — Quang T Van
(74) *Attorney, Agent, or Firm* — Wenderoth, Lind & Ponack, L.L.P.

(57) ABSTRACT

A microwave heating device includes a heating chamber that accommodates an object to be heated, a microwave generator configured to generate microwaves, a wave guide tube configured to guide the microwaves to the heating chamber, and an electromagnetic field distribution adjustment device that is provided in a two-dimensional region located in at least a part of a wall face within the heating chamber. The electromagnetic field distribution adjustment device has a plurality of metal pieces arranged to fill a predetermined two-dimensional region, and a switch provided between two metal pieces adjacent to each other among the plurality of metal pieces. The switch is connected to the two metal
(Continued)

pieces adjacent to each other through two conductors each of which is provided on a corresponding one of the two metal pieces adjacent to each other, and smaller than the two metal pieces adjacent to each other. According to the present aspect, uneven heating, which is caused by heating an object to be heated with a microwave heating device, can be reduced.

6 Claims, 15 Drawing Sheets

(58) Field of Classification Search
USPC ..... 219/690, 678, 728–729, 739, 732, 734, 219/738, 710, 702, 745, 747, 749, 756, 219/757, 762; 361/143, 146; 422/22, 422/105; 426/103, 114, 234, 87; 118/723 MW; 250/492.1
See application file for complete search history.

(56) References Cited

FOREIGN PATENT DOCUMENTS

| | | |
|---|---|---|
| JP | 2001-292001 | 10/2001 |
| TW | M374659 | 2/2010 |
| WO | 2008/050441 | 5/2008 |
| WO | 2015/133081 | 9/2015 |

OTHER PUBLICATIONS

Takahiro Hirose et al., "Analytic Study on Improvement of Uneven Heating in Microwave Oven by Using Planar Electromagnetic Field Stirrer Considering Diode Impedance", Conference Proceedings: 2017-10023-101, The 2017 IEICE General Conference, C-2-88, Mar. 7, 2017 (With Full English Translation).
Extended European Search Report issued Dec. 5, 2019 in corresponding European Patent Application No. 17891727.4.

* cited by examiner

| | 2.4GHz | 2.45GHz | 2.5GHz |
|---|---|---|---|
| 1.2nH |  |  |  |
| 1.6nH |  |  |  |
| 2.0nH |  |  |  |

| | 2.4GHz | 2.45GHz | 2.5GHz |
|---|---|---|---|
| 0.1pF |  |  |  |
| 0.22pF |  |  |  |
| 0.3pF |  |  |  |

ELECTROMAGNETIC FIELD DISTRIBUTION ADJUSTMENT DEVICE AND MICROWAVE HEATING DEVICE

TECHNICAL FIELD

The present disclosure relates to an electromagnetic field distribution adjustment device and a microwave heating device including the same.

BACKGROUND ART

For microwave heating devices such as a microwave oven, it is desired to heat an object to be heated, which is accommodated in a heating chamber, uniformly without heating it unevenly. To achieve the above-mentioned aim, various configurations have been considered (e.g., see Patent Literature 1).

Patent Literature 1 discloses an electromagnetic field distribution adjustment device that has a large number of metal pieces arranged in a matrix manner, and a large number of switches each connecting two metal pieces adjacent to each other among the large number of metal pieces. The electromagnetic field distribution adjustment device changes impedance near a metal piece, which is included in the large number of metal pieces, in response to operation of the switch. This makes it possible to move a position of a standing wave generated near the metal piece, so that uneven heating can be reduced.

CITATION LIST

Patent Literature

PTL 1: International Publication 2015/133081

SUMMARY OF THE INVENTION

Patent Literature 1, however, does not disclose clearly the way how to connect a metal piece and a switch.

To solve the above-mentioned conventional problem, the present disclosure provides a concrete configuration of an electromagnetic field distribution adjustment device.

The electromagnetic field distribution adjustment device in one aspect of the present disclosure includes: a plurality of metal pieces arranged to fill a predetermined two-dimensional region; and a switch provided between two metal pieces adjacent to each other among the plurality of metal pieces.

The switch is connected to the two metal pieces adjacent to each other through two conductor parts, the two conductor parts each being provided on a corresponding one of the two metal pieces adjacent to each other, the two conductor parts each being smaller than each of the two metal pieces adjacent to each other.

The present aspect can reduce uneven heating that occurs when a microwave heating device heats an object to be heated.

DESCRIPTION OF EMBODIMENT(S)

Figure 1:
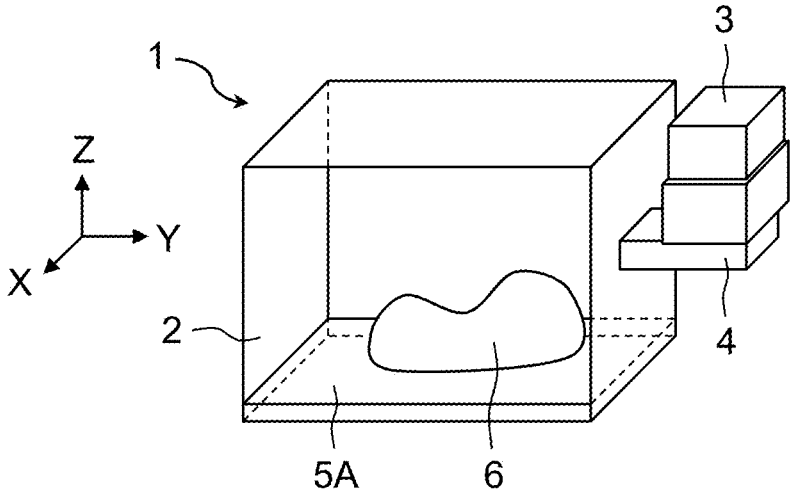
FIG. 1 is a perspective view of a microwave heating device including an electromagnetic field distribution adjustment device in accordance with an exemplary embodiment of the present disclosure.

The electromagnetic field distribution adjustment device in a first aspect of the present disclosure includes a plurality of metal pieces arranged to fill a predetermined two-dimensional region, and a switch provided between two metal pieces adjacent to each other among the plurality of metal pieces.

The switch is connected to the two metal pieces adjacent to each other through two conductor parts, the two conductor parts each being provided on a corresponding one of the two metal pieces adjacent to each other, the two conductor parts each being smaller than each of the two metal pieces adjacent to each other.

According to the electromagnetic field distribution adjustment device in a second aspect of the present disclosure, in the first aspect, a distance between the two metal pieces is less than or equal to one half of wavelength of a microwave.

According to the electromagnetic field distribution adjustment device in a third aspect of the present disclosure, in the first aspect, the switch is a diode that is smaller than each of the two conductor parts and has a breakdown voltage characteristic.

According to the electromagnetic field distribution adjustment device in a fourth aspect of the present disclosure, in the third aspect, the diode has an impedance of 200Ω or less when a forward bias is applied thereto through electromagnetic waves, and has an impedance of 800Ω or more when a reverse bias is applied thereto through electromagnetic waves.

According to the electromagnetic field distribution adjustment device in a fifth aspect of the present disclosure, in the fourth aspect, an equivalent circuit of the diode is a series circuit constituted by a resistor with a resistance of approximately 3Ω and an inductor with an inductance of approximately 1.6 nH when a forward bias is applied to the diode through electromagnetic waves, and the equivalent circuit of the diode is a parallel circuit constituted by a resistor with a resistance of approximately 10 MΩ and a capacitor with a capacitance of approximately 0.22 pF when a reverse bias is applied to the diode through electromagnetic waves.

A microwave heating device in a seventh aspect of the present disclosure includes: a heating chamber that accommodates an object to be heated; a microwave generator configured to generate microwaves; a wave guide tube configured to guide the microwaves to the heating chamber; and an electromagnetic field distribution adjustment device provided in a two-dimensional region located in at least a part of a wall face within the heating chamber.

The electromagnetic field distribution adjustment device has a plurality of metal pieces arranged to fill a predetermined two-dimensional region, and a switch provided between two metal pieces adjacent to each other among the plurality of metal pieces. The switch is connected to the two metal pieces adjacent to each other through two conductor parts each of which is provided on a corresponding one of the two metal pieces adjacent to each other and smaller than the two metal pieces adjacent to each other.

Hereinafter, exemplary embodiments of the present disclosure will be described with reference to the drawings.

Figure 2:
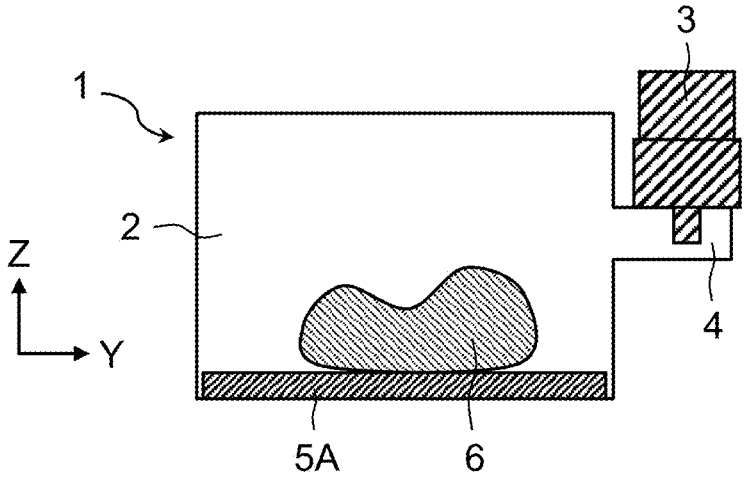
FIG. 2 is a longitudinal sectional view of the microwave heating device in accordance with the present exemplary embodiment.

FIG. 1 is a perspective view of microwave heating device 1 in accordance with an exemplary embodiment of the present disclosure. FIG. 2 is a longitudinal sectional view of microwave heating device 1.

In the present exemplary embodiment, microwave heating device 1 is a microwave oven having heating chamber 2. In FIG. 1, a front wall of heating chamber 2 is omitted such that the inside of heating chamber 2 can be seen.

As shown in FIGS. 1 and 2, in addition to heating chamber 2, microwave heating device 1 includes microwave generator 3, wave guide tube 4, and electromagnetic field distribution adjustment device 5A. In the present disclosure, a back-and-forth direction, a horizontal direction, and a vertical direction of heating chamber 2 are defined as X-direction, Y-direction, and Z-direction, respectively.

In a front opening of heating chamber 2, a door (not shown) is provided, and object 6 to be heated is accommodated in an inner space of heating chamber 2.

Microwave generator 3 is constituted by a magnetron or the like, and generates a microwave. Wave guide tube 4 guides the microwave from microwave generator 3 to heating chamber 2. In the present exemplary embodiment, an opening of wave guide tube 4 is provided in a side wall of heating chamber 2.

Electromagnetic field distribution adjustment device 5A is provided in a predetermined two-dimensional region within heating chamber 2. Electromagnetic field distribution adjustment device 5A changes impedance on its face opposite to the inner space of heating chamber 2. Thus, electromagnetic field distribution adjustment device 5A changes an electromagnetic field distribution, i.e., a standing wave distribution in the vicinity thereof. As a result, the heating distribution on object 6 to be heated can be changed, so that uniform heating of object 6 to be heated can be achieved.

If object 6 to be heated is placed near electromagnetic field distribution adjustment device 5A, uniform heating effect will be obtained easily. In the present exemplary embodiment, the predetermined two-dimensional region corresponds to an entire bottom face of heating chamber 2. In this case, object 6 to be heated is placed on electromagnetic field distribution adjustment device 5A.

Figure 3:
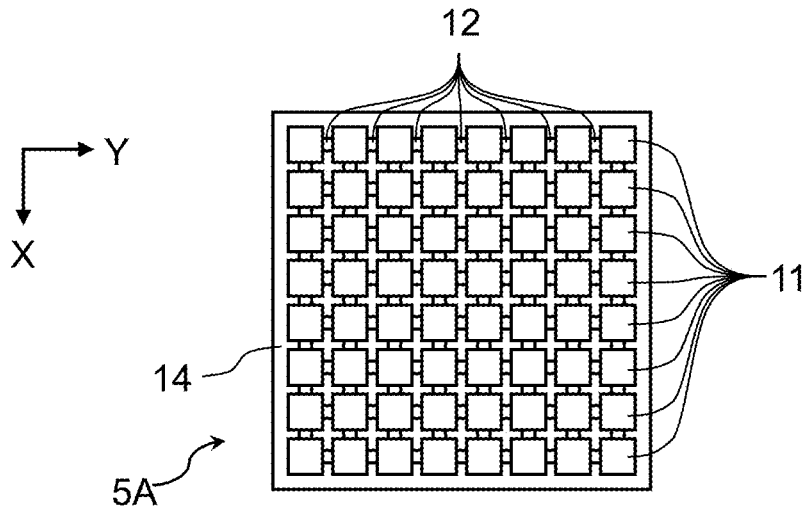
FIG. 3 is a top view of the electromagnetic field distribution adjustment device in accordance with the present exemplary embodiment.
Figure 4:
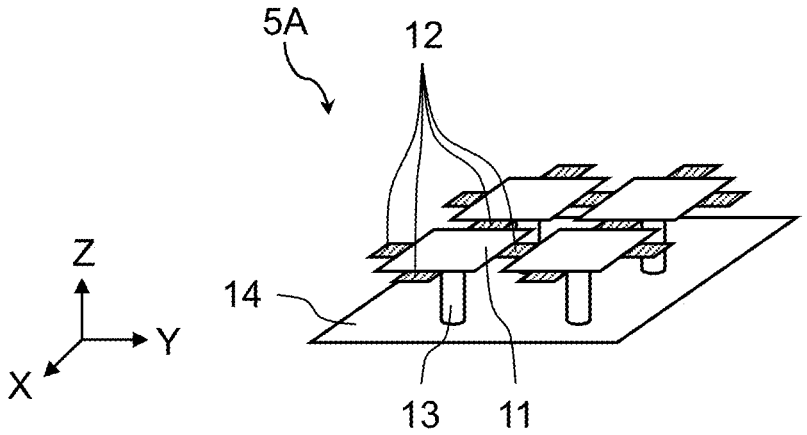
FIG. 4 is a perspective view of the electromagnetic field distribution adjustment device in accordance with the present exemplary embodiment.

FIG. 3 and FIG. 4 are a top view and a perspective view of electromagnetic field distribution adjustment device 5A, respectively. As shown in FIGS. 3 and 4, electromagnetic field distribution adjustment device 5A includes a plurality of metal pieces 11, a plurality of switches 12, a plurality of short-circuiting conductors 13, and grounding conductor 14.

Grounding conductor 14 is provided along the bottom face of heating chamber 2. Grounding conductor 14, which corresponds to a bottom face of electromagnetic field distribution adjustment device 5A, is an electrically grounded surface having a reference potential.

Switch 12 is provided between two metal pieces 11 adjacent to each other in a column direction (X-direction shown in FIGS. 3 and 4).

Metal piece 11 is a square metal plate whose one side has a length less than one half of wavelength of the microwave. The plurality of metal pieces 11 are arranged on a plane, which is in parallel to grounding conductor 14, in a matrix manner such that the plurality of metal pieces 11 are opposite to grounding conductor 14.

Short-circuiting conductor 13 connects metal piece 11 to grounding conductor 14. A combination of metal piece 11 and short-circuiting conductor 13 is referred to as a unit cell with a mushroom structure.

Dimensions such as length of one side of metal piece 11 and height of short-circuiting conductor 13 are designed such that, when switch 12 is opened, electromagnetic field distribution adjustment device 5A functions as a magnetic wall, with respect to the microwave.

Figure 5A:
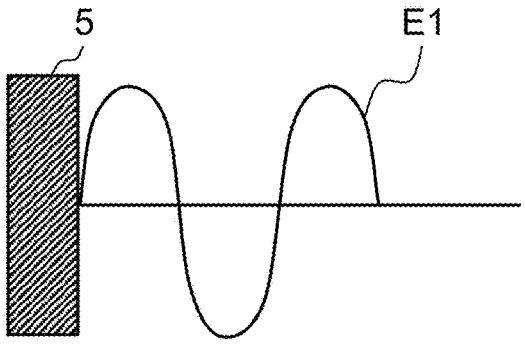
FIG. 5A is a view showing electric field distribution E1 near the electromagnetic field distribution adjustment device when a switch is closed.
Figure 5B:
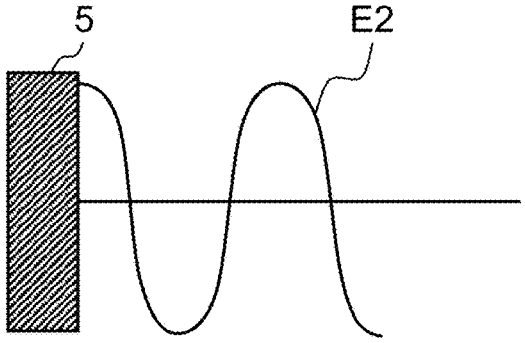
FIG. 5B is a view showing electric field distribution E2 near the electromagnetic field distribution adjustment device when the switch is opened.

FIG. 5A shows electric field distribution E1 near electromagnetic field distribution adjustment device 5A when switch 12 is closed. FIG. 5B shows electric field distribution E2 near electromagnetic field distribution adjustment device 5A when switch 12 is opened.

A plane including switch 12 and metal piece 11 functions as a conductor plate, when switch 12 is closed. In this case, electromagnetic field distribution adjustment device 5A constitutes a short-circuit plane that has substantially zero impedance near the plurality of metal pieces 11.

As shown in FIG. 5A, if electromagnetic waves are reflected on the short-circuit plane, a standing wave whose node lies on the short-circuit plane, i.e., surfaces of the plurality of metal pieces 11 will be formed.

Electromagnetic field distribution adjustment device 5A functions as an electric wall that has substantially zero impedance near the plurality of metal pieces 11.

When switch 12 is opened, electromagnetic field distribution adjustment device 5A constitutes a meta-material in which a large number of unit cells are arranged two-dimensionally and periodically. In this case, electromagnetic field distribution adjustment device 5A functions as a magnetic wall that has substantially infinite impedance near the plurality of metal pieces 11. Herein, the expression of "arranged two-dimensionally and periodically" means that a plurality of objects with the same structure are arranged at constant intervals in a longitudinal direction and a transverse direction.

Even if switch 12 is opened, two metal pieces 11 adjacent to each other are conducted through two short-circuiting conductors 13 and grounding conductor 14. Therefore, direct current can flow between these metal pieces.

The microwave, however, can hardly propagate between these metal pieces because metal piece 11 and short-circuiting conductor 13 have the above-mentioned dimensions.

Accordingly, electromagnetic field distribution adjustment device 5A constitutes an open plane that has substantially infinite impedance near the plurality of metal pieces 11. As shown in FIG. 5B, if electromagnetic waves are reflected on the open plane, a standing wave whose antinode lies on the open plane, i.e., surfaces of the plurality of metal pieces 11 will be formed.

In this way, by changing the impedance, electromagnetic field distribution adjustment device 5A can interchange positions of a node and an antinode of the standing wave generated by reflecting on electromagnetic field distribution adjustment device 5A.

Figure 6:
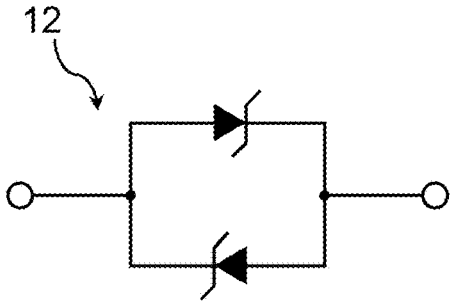
FIG. 6 is a view exemplarily showing the switch included in the electromagnetic field distribution adjustment device in accordance with the present exemplary embodiment.

FIG. 6 shows an example of switch 12 in accordance with the present exemplary embodiment. As shown in FIG. 6, two Zener diodes are parallelly connected in reverse directions from each other to constitute switch 12.

In the case where switch 12 is an element that has a breakdown voltage characteristic such as that of a Zener diode, if electromagnetic waves reach near switch 12, a potential difference larger than a predetermined threshold (breakdown voltage) will occurs between two metal pieces 11 connected to both ends of switch 12. At this time, switch 12 is changed from an open state to a closed state automatically.

Therefore, at a portion having a strong electromagnetic field in electromagnetic field distribution adjustment device 5A, the impedance changes into substantially zero automatically, so that a node of the standing wave occurs at the portion. Thus, the electromagnetic field at the portion is weakened automatically, thereby making it possible to prevent occurrence of uneven heating. Switch 12 may be a PIN diode or the like, for example.

As mentioned above, according to the present exemplary embodiment, the impedance of electromagnetic field distribution adjustment device 5A is set to be substantially zero or substantially infinite, thereby making it possible to interchange positions of a node and an antinode of the standing wave generated near electromagnetic field distribution adjustment device 5A, selectively. Thus, uneven heating can be reduced.

Hereinafter, electromagnetic field distribution adjustment device 5B in accordance with a modification of the present exemplary embodiment will be described. In electromagnetic field distribution adjustment device 5B, a large number of metal pieces 11 are arranged on a dielectric substrate two-dimensionally and periodically. The back of the dielectric substrate is in contact with a wall face made of a conductive member within heating chamber 2. In other words, electromagnetic field distribution adjustment device 5B has no grounding conductor 14.

In the following description, it is assumed that a plurality of unit cells are arranged two-dimensionally and periodically to constitute electromagnetic field distribution adjustment device 5B, for convenience. Herein, the plurality of unit cells 21 each include metal piece 11 and a part of the dielectric substrate surrounding metal piece 11.

Figure 7:
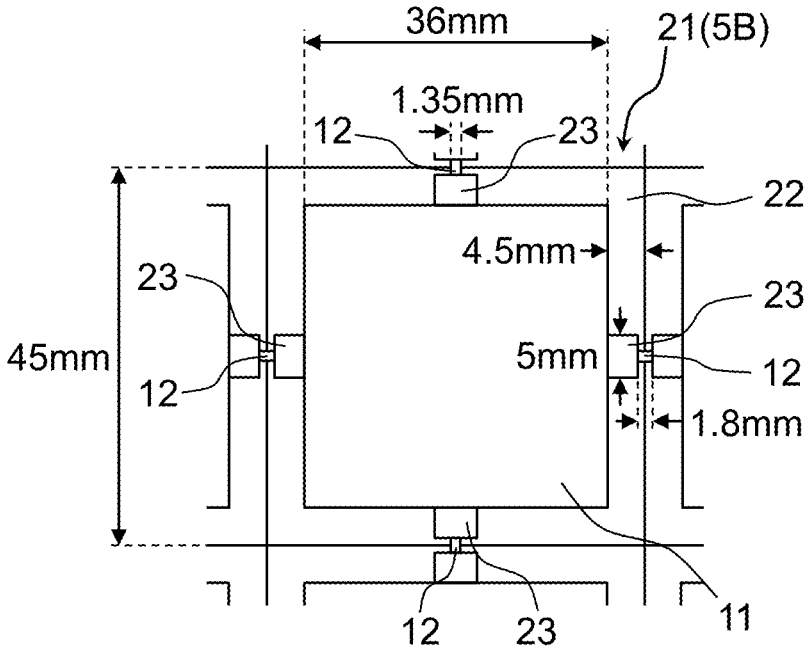
FIG. 7 is a plan view of an electromagnetic field distribution adjustment device in accordance with a modification of the present exemplary embodiment.
Figure 8:
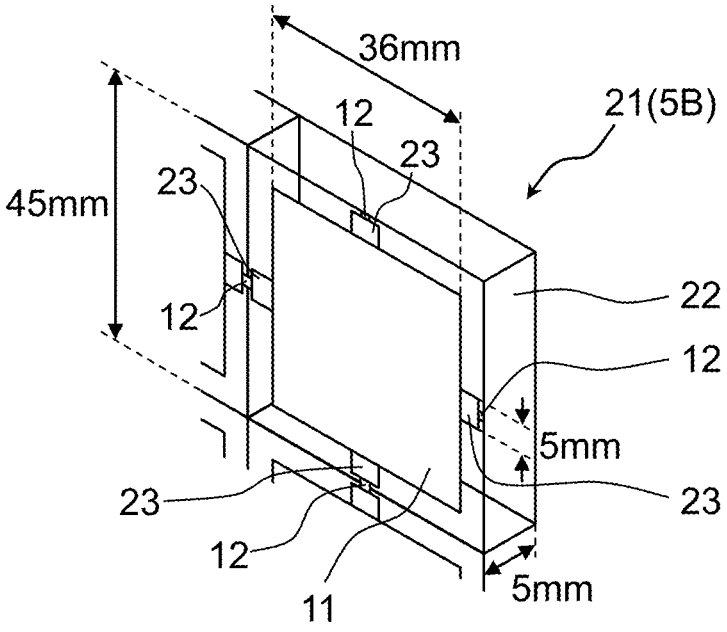
FIG. 8 is a perspective view of the electromagnetic field distribution adjustment device in accordance with the modification of the present exemplary embodiment.

FIG. 7 is a plan view of unit cell 21 constituting electromagnetic field distribution adjustment device 5B in accordance with the modification of the present exemplary embodiment. FIG. 8 is a perspective view of unit cell 21. As shown in FIGS. 7 and 8, unit cell 21 includes metal piece 11, dielectric 22, and conductor parts 23.

Dielectric 22 is a part of the dielectric substrate surrounding metal piece 11. Dielectric 22 has a square shape whose one side has a length of 45 mm. Metal piece 11 has a square shape whose one side has a length of 36 mm, and is placed on a surface center of dielectric 22.

Conductor part 23 is a metallic member extending outwardly from a center portion of each side of metal piece 11. The metallic member is provided integrally with metal piece 11 and has a rectangle shape with a width of 5 mm.

Switch 12 is formed in a gap with a length of 1.8 mm. The gap is interposed between two conductor parts 23 provided between two adjacent metal pieces 11 so as to face each other. Two diodes 24 are parallelly connected in reverse directions from each other to constitute switch 12 (see FIG. 6). Diode 24 is a Zener diode, for example.

The width of conductor part 23 is made smaller than the width of metal piece 11 such that unit cell 21 is not prevented from functioning as electromagnetic field distribution adjustment device 5B.

As mentioned above, in the present modification, switch 12 is connected to two metal pieces 11 adjacent to each other through two conductor parts 23 each of which is provide on a corresponding one of the two metal pieces 11 adjacent to each other, and smaller than metal piece 11 adjacent to each other.

Figure 9:
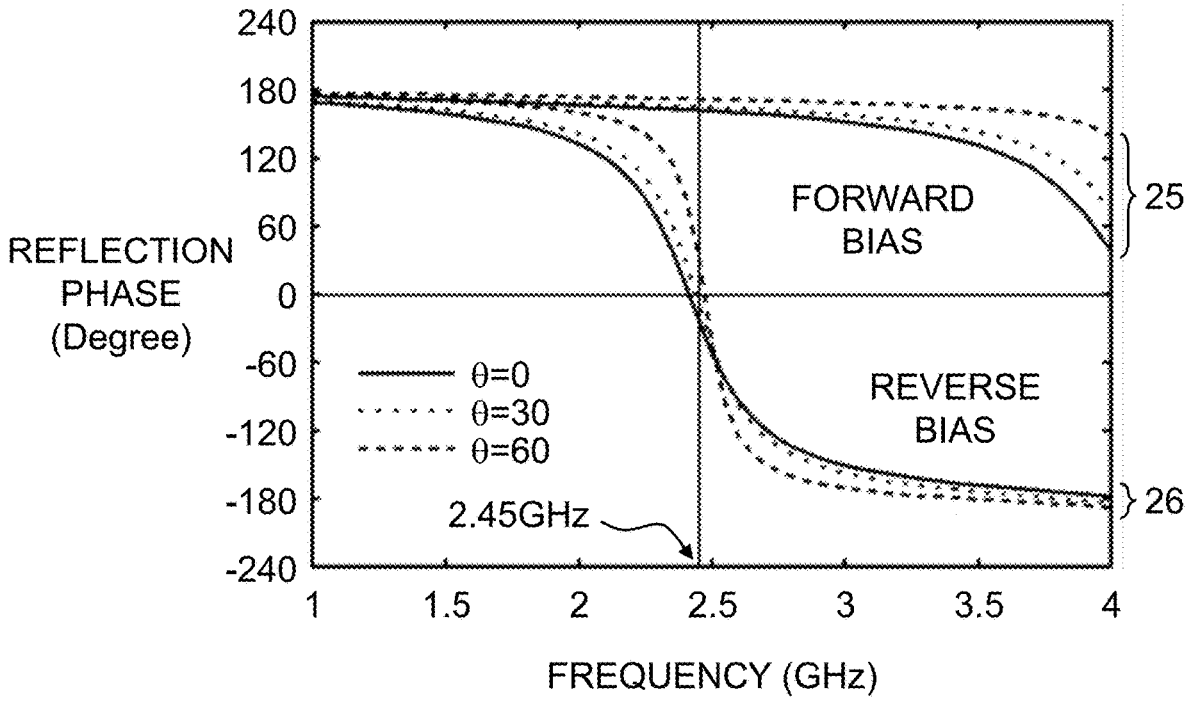
FIG. 9 is a view showing frequency characteristics related to a reflection phase of a unit cell in accordance with the modification of the present exemplary embodiment.

FIG. 9 is a view showing frequency characteristics related to a reflection phase of unit cell 21. In FIG. 9, characteristic curve group 25 is a bundle of characteristic curves when a forward bias is applied to diode 24 and then diode 24 is turned on. Characteristic curve group 26 is a bundle of characteristic curves when a reverse bias is applied to diode 24 and then diode 24 is turned off.

When unit cell 21 is irradiated with the microwave at an incident angle θ of 0 degrees, the characteristic curve is indicated by a dashed line. Further, when unit cell 21 is irradiated with the microwave at an incident angle θ of 30 degrees, the characteristic curve is indicated by a dotted line. Furthermore, when unit cell 21 is irradiated with the microwave at an incident angle θ of 60 degrees, the characteristic curve is indicated by a solid line. Herein, the incident angle θ of 0 degrees means that the microwave enters perpendicular to metal piece 11, and the incident angle θ of 90 degrees means that the microwave enters in parallel to metal piece 11.

As shown in FIG. 9, for the microwave with a frequency of 2.45 GHz, which is used for a microwave oven, when diode 24 is turned on, unit cell 21 has a reflection phase of 180 degrees. In this case, unit cell 21 functions as an electric wall.

When diode 24 is turned off, the reflection phase changes into 0 degrees. In this case, unit cell 21 turns into a resonance state, so that unit cell 21 functions as a magnetic wall. In this way, the reflection phase can be reversed depending on a direction of the bias applied to diode 24.

It is thought that the phenomenon is caused by changing the impedance of unit cell 21 through operation of diode 24. This applies to all cases, i.e., at incident angles of 0 degrees, 30 degrees, and 60 degrees. In other words, electromagnetic field distribution adjustment device 5B in accordance with the present exemplary embodiment can reverse the reflection phase in response to irradiation of the microwave, not depending on an incident angle of the microwave.

Hereinafter, the influence of distance L between two metal pieces 11 adjacent to each other on characteristics of unit cell 21 will be described with reference to FIGS. 10A through 14.

Figure 10A:
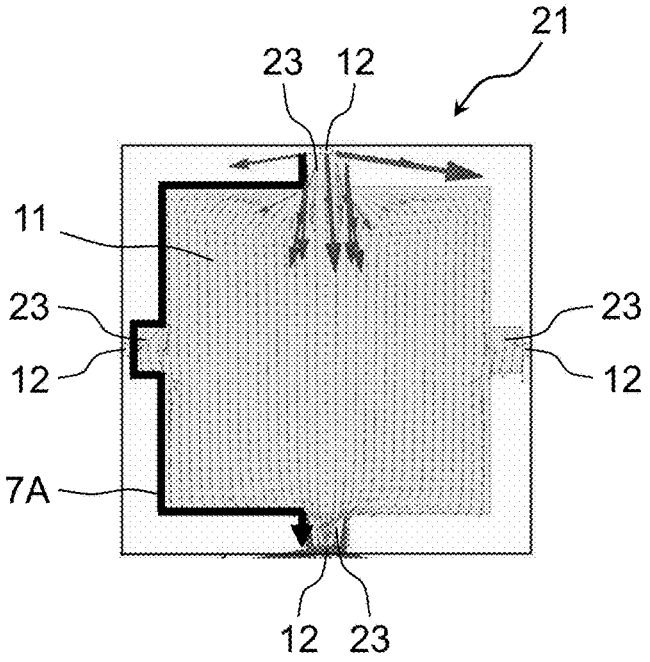
FIG. 10A is a view showing current vectors when current flows through a unit cell having a large metal piece.
Figure 10B:
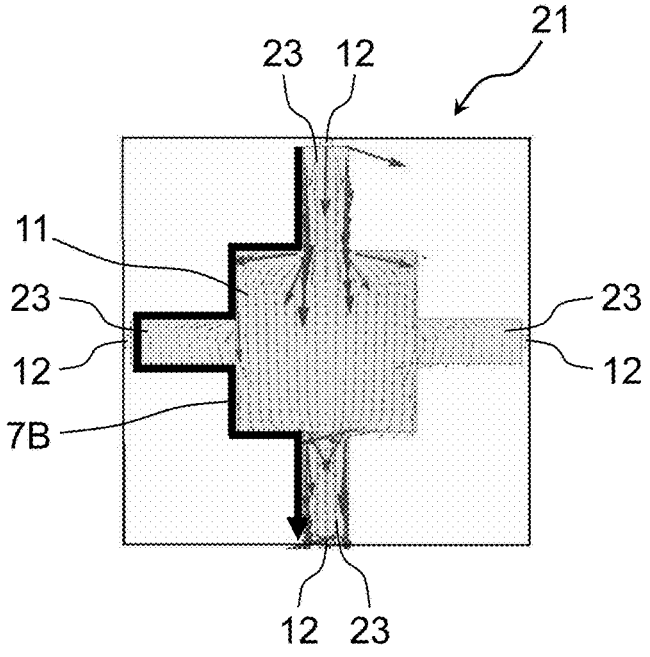
FIG. 10B is a view showing current vectors when current flows through a unit cell having a small metal piece.

FIG. 10A shows current vectors when current flows through unit cell 21 having large metal piece 11 and short conductor part 23. FIG. 10B shows current vectors when current flows through unit cell 21 having small metal piece 11 and long conductor part 23. These results have been obtained through simulation.

As shown in FIGS. 10A and 10B, current components flowing along edges of metal piece 11 and conductor part 23 are more than current components flowing through the remaining portions.

In FIG. 10A, path 7A indicated by an arrow line is a current path flowing along left-hand side edges of metal piece 11 and conductor part 23 downwardly. In FIG. 10B, path 7B indicated by an arrow line is a current path flowing along left-hand side edges of metal piece 11 and conductor part 23 downwardly.

When metal piece 11 and conductor part 23 have a square shape or a rectangular shape, peripheral length of an area obtained by combining metal piece 11 and conductor part 23 is constant, not depending on sizes of metal piece 11 and conductor part 23. Therefore, the length of path 7A is equal to the length of path 7B.

In other words, as long as metal piece 11 and conductor part 23 have the above-mentioned shapes, these shapes may scarcely affect the resonance frequency.

However, when electromagnetic field distribution adjustment device 5B is actually placed in a microwave oven, it has been founded that heating performance changes depending on the shape of unit cell 21. Hereinafter, this will be described.

Figure 11:
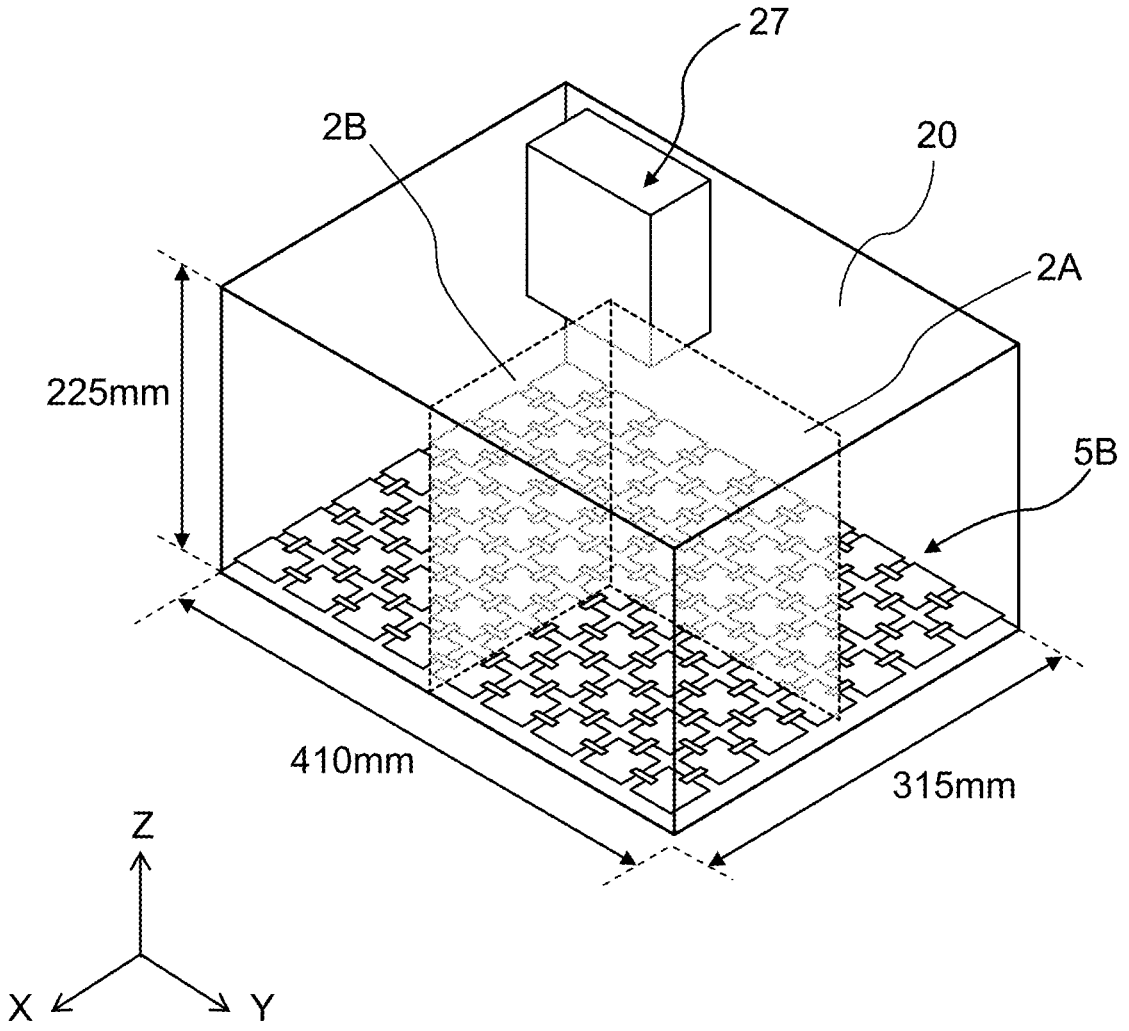
FIG. 11 is a perspective view of a heating chamber used as a simulation model.

FIG. 11 is a view showing heating chamber 20 used as a simulation model. In FIG. 11, a front wall of heating chamber 20 is omitted such that the inside of heating chamber 20 can be seen. As shown in FIG. 11, heating chamber 20 of the present simulation has wave guide tube 27 provided on an upper surface of heating chamber 20, and electromagnetic field distribution adjustment device 5B provided over the entire lower surface of heating chamber 20, which faces wave guide tube 27.

Figure 12:
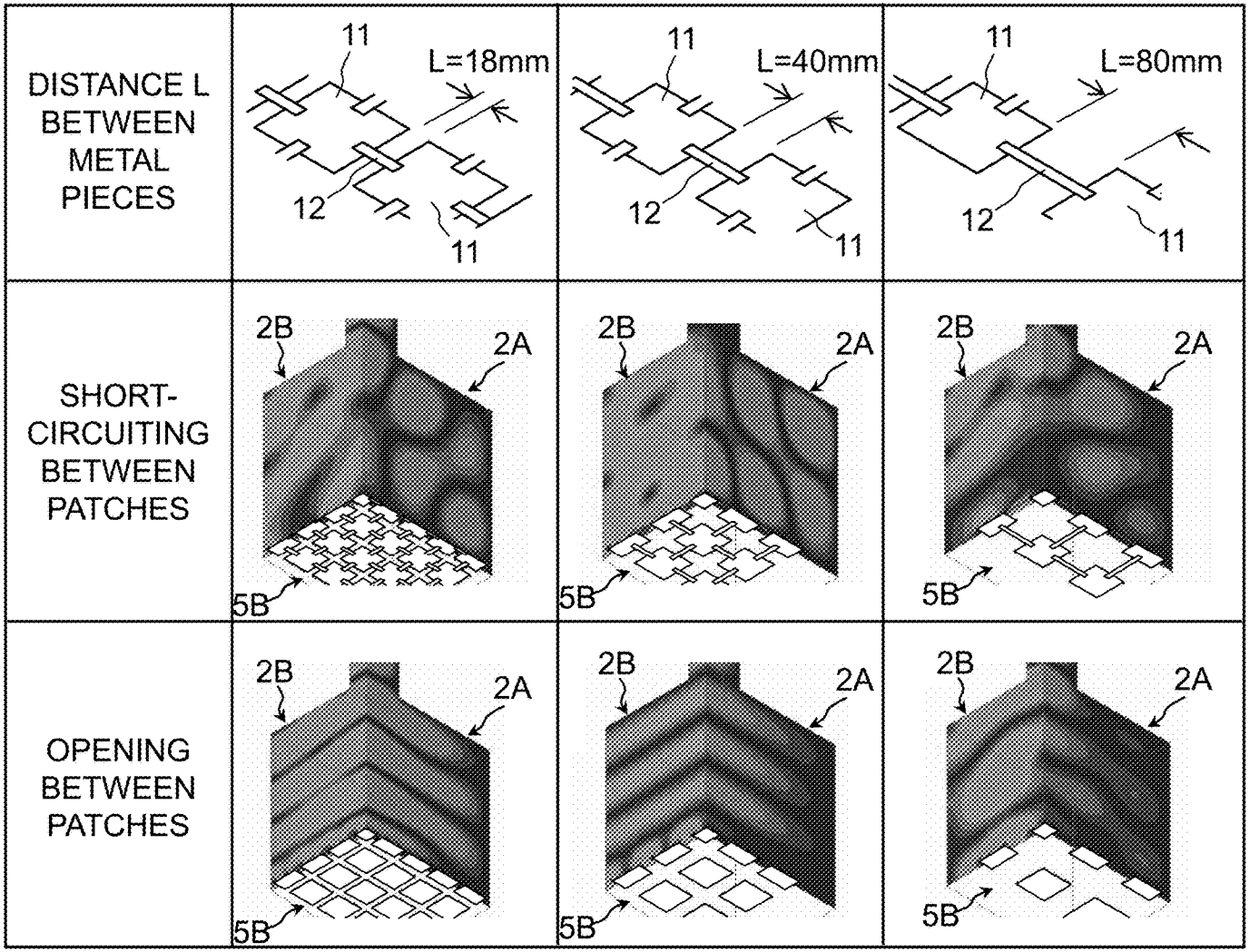
FIG. 12 is a view showing simulation results of electric field distributions generated in the heating chamber.

FIG. 12 shows simulation results of electric field distributions generated on virtual planes 2A and 2B within heating chamber 20 in the cases of "short-circuiting between patches" and "opening between patches."

In the present simulation, the following three configurations of electromagnetic field distribution adjustment device 5B are employed. Virtual plane 2A virtually divides heating chamber 2 into a front half portion and a rear half portion, and virtual plane 2B virtually divides heating chamber 20 into a left half portion and a right half portion (see FIG. 11).

As shown in FIG. 12, in the three configurations, metal piece 11 has the same size. A first configuration is set to have a distance L of 18 mm. A second configuration and a third configuration are set to have a distance L of 40 mm and a distance L of 80 mm, respectively. The length of conductor part 23 is determined based on distance L. In FIG. 12, shades of an image, which are displayed as the simulation result, indicate an electric field distribution. In other words, the electric field at a lighter color portion is stronger than the electric field at a deeper color portion.

"Short-circuiting between patches" means that conductor part 23 is provided between metal pieces 11, and "opening between patches" means that conductor part 23 is not provided between metal pieces 11.

When distance L is 18 mm, a great difference occurs in electric field distributions between the case of "short-circuiting between patches" and the case of "opening between patches." In other words, the operation of switch 12 seriously changes the electric field distributions, so that a heating pattern of an object to be heated is changed significantly.

When distance L is 80 mm, similar electric field distributions are generated between the case of "short-circuiting between patches" and the case of "opening between patches." In other words, the operation of switch 12 does not change the electric field distributions so much, so that a heating pattern of an object to be heated is not changed so much.

The results at a distance L of 40 mm are similar to the results at a distance L of 18 mm, rather than the results at a distance L of 80 mm.

As mentioned above, desirable effects are obtained at a distance L of 18 mm, and certain effects are obtained at a distance L of 40 mm. At a distance L of 80 mm, however, no desirable effects are obtained. In short, the smaller distance L is, the better it is.

This phenomenon is thought to depend on the wavelength of a microwave to be used. In other words, in the case where the microwave has a frequency of 2.45 GHz, one half of wavelength of the microwave is approximately 60 mm. If distance L is less than or equal to 60 mm, a desirable result will be obtained. If not, the microwave passing through the gap will be increased. This may deteriorate the performance of electromagnetic field distribution adjustment device 5B. However, the evaluation of only one unit cell is not enough to find this.

For instance, in the simulation shown in FIGS. 10A and 10B, the result shows that the size of metal piece 11 has no influence thereon when only one unit cell is evaluated.

However, in the case where a plurality of unit cells are arranged two-dimensionally, if the size of metal piece 11 is small, distance L will be large. When distance L is larger than one half of the wavelength, the effect of reducing uneven heating is deteriorated. Accordingly, to obtain better effect of reducing uneven heating, distance L is desirably less than or equal to one half of wavelength of the microwave.

Figure 13:
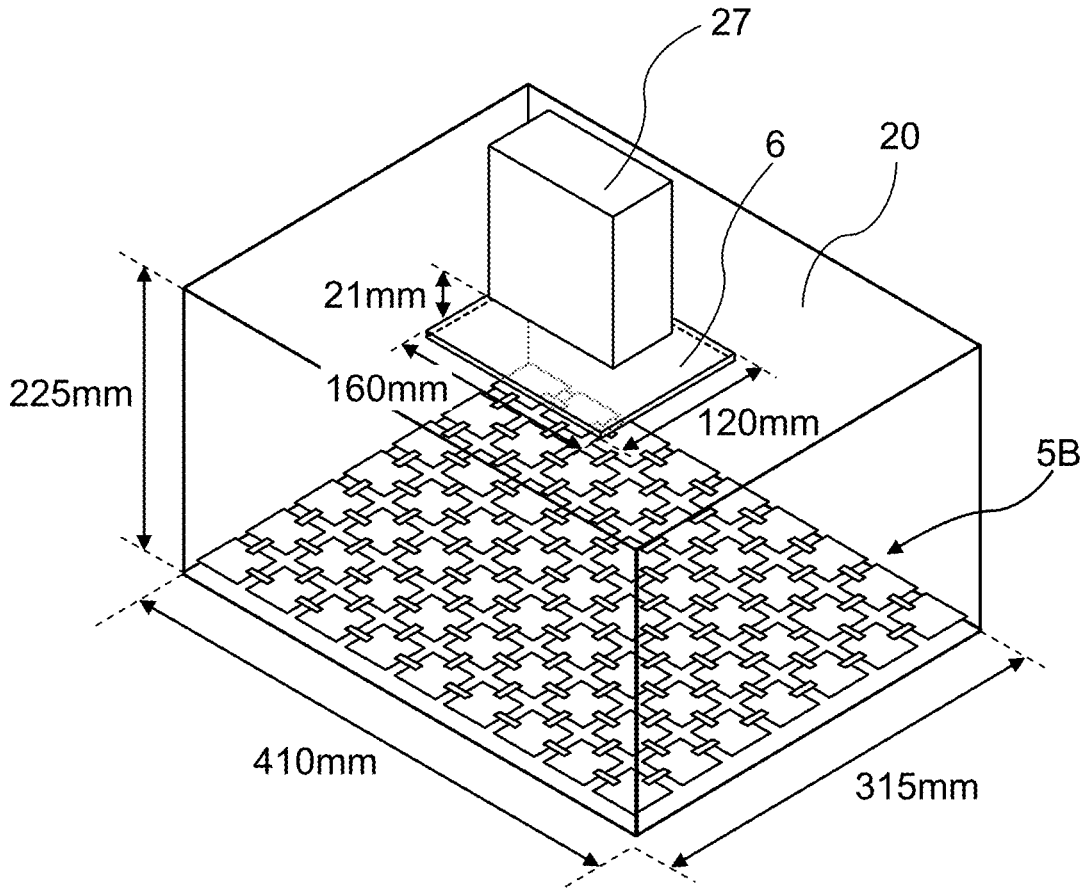
FIG. 13 is a perspective view of the heating chamber shown in FIG. 11 in which an object to be heated is placed to analyze a temperature distribution.
Figure 14:
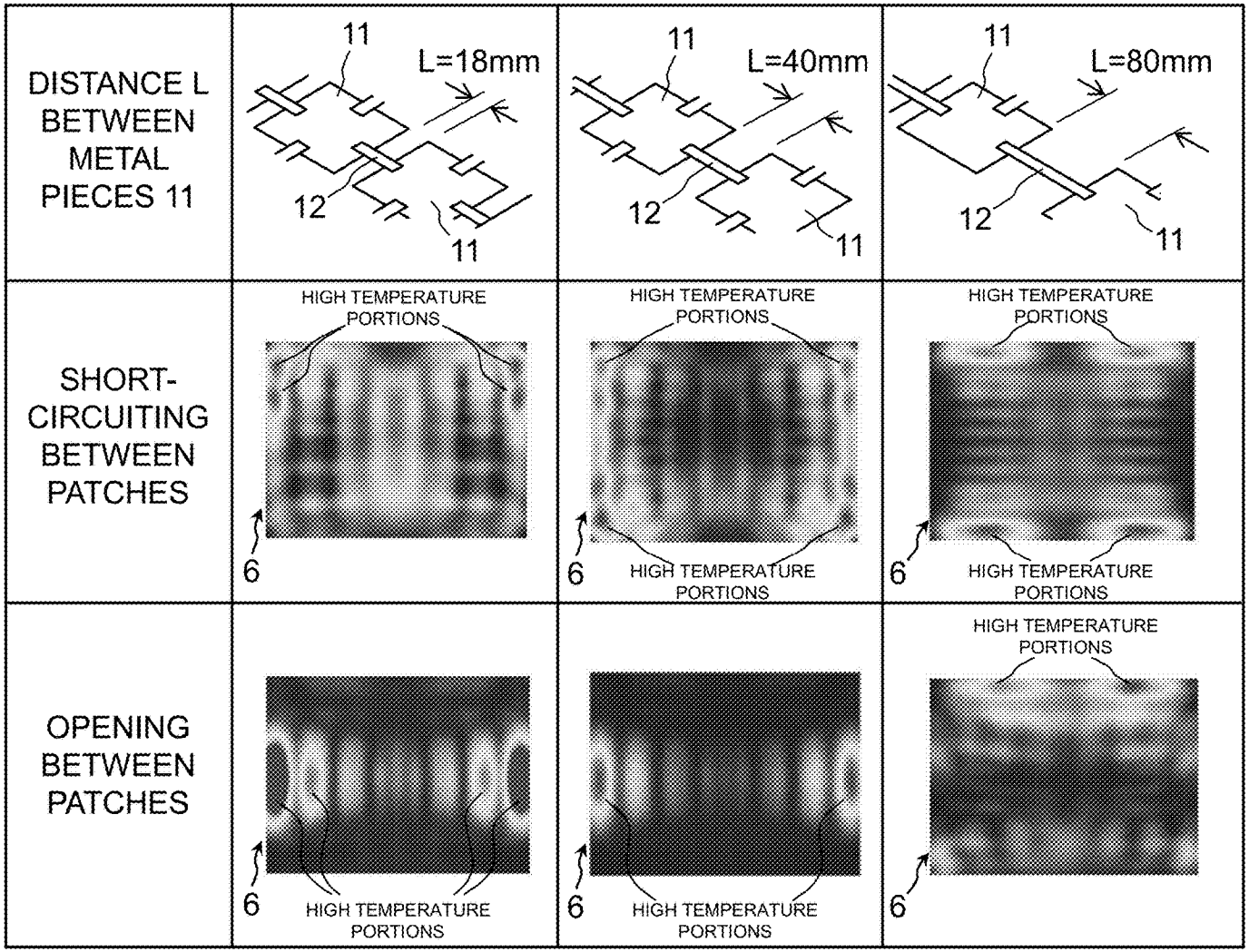
FIG. 14 is a view showing temperature distributions on the object to be heated for three different configurations of the electromagnetic field distribution adjustment device.

FIG. 13 is a perspective view of heating chamber 20 shown in FIG. 11. In heating chamber 20, object 6 to be heated (agar) is placed to analyze a temperature distribution. FIG. 14 shows simulation results of temperature distributions generated on object 6 to be heated, which is placed in heating chamber 20, in the cases of "short-circuiting between patches" and "opening between patches." In the simulation, electromagnetic field distribution adjustment devices 5B whose distances L each are set to be a corresponding one of 18 mm, 40 mm, and 80 mm are employed.

For temperature distributions generated on the agar in FIG. 14, when distance L is 18 mm, a great difference occurs in temperature distributions between the case of "short-circuiting between patches" and the case of "opening between patches." In other words, this configuration enhances the effect of reducing uneven heating.

When distance L is 80 mm, little difference occurs in temperature distributions between the case of "short-circuiting between patches" and the case of "opening between patches." In other words, this configuration deteriorates the effect of reducing uneven heating.

The result at a distance L 40 mm, if anything, is similar to the result at a distance L of 18 mm. However, there is a big difference therebetween, in fact.

For temperature in a center portion of the agar in FIG. 14, when distance L is 18 mm, the temperature in the case of "short-circuiting between patches" is high, and the temperature in the case of "opening between patches" is low. When distance L is 40 mm, however, the center temperature in both the cases is low.

As mentioned above, when distance L is 18 mm, the best heating characteristic is obtained among the three above-mentioned configurations. This phenomenon is thought to depend on the wavelength of a microwave to be used.

When the microwave has a frequency of 2.45 GHz, one fourth of wavelength of the microwave is approximately 30 mm. If distance L is less than or equal to 30 mm, a desirable result will be obtained. If not, the microwave passing through the gap will be increased. This may deteriorate the performance of electromagnetic field distribution adjustment device 5B. However, the evaluation of only the electric field distribution shown in FIG. 12 is not enough to find this.

For instance, in the simulation shown in FIG. 12, the result shows that, if distance L is smaller than one half of wavelength of the microwave, better effects will be obtained. To obtain the maximum effect of reducing uneven heating, however, distance L is desirably less than or equal to one fourth of wavelength of the microwave.

Hereinafter, specifications required for diode 24 used in unit cell 21 shown in FIGS. 7 and 8 will be described with reference to FIGS. 15 through 20.

Figure 15:
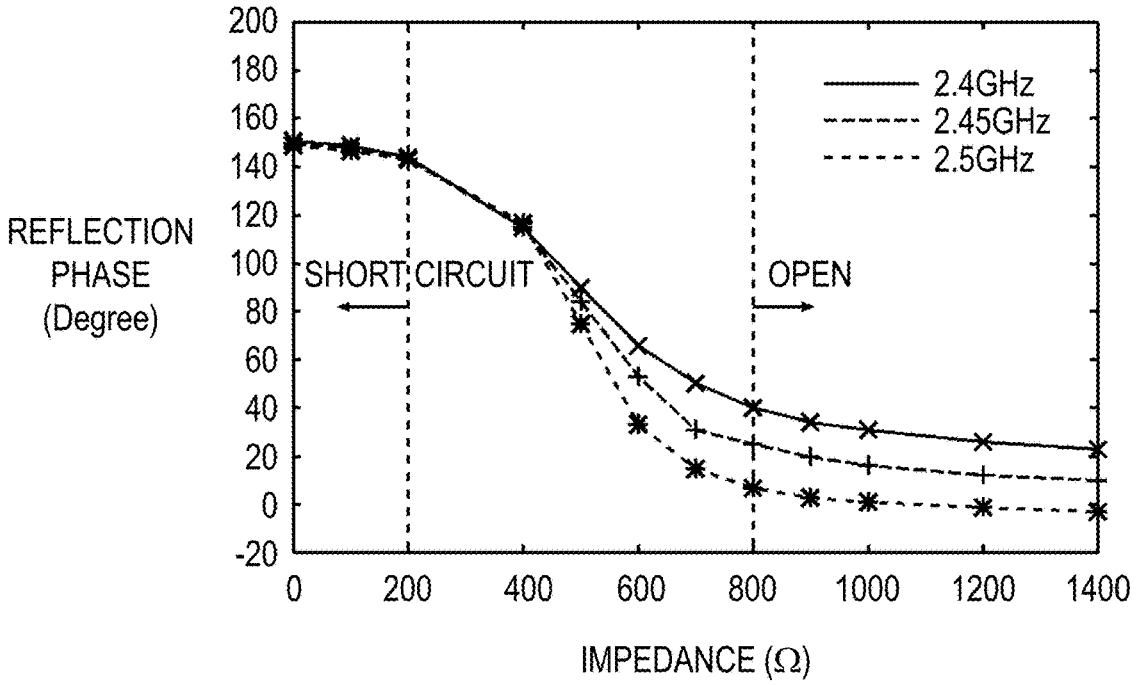
FIG. 15 is a characteristic diagram showing a relationship between a diode impedance and a reflection phase of the unit cell.

FIG. 15 is a characteristic diagram showing a relationship between an impedance of diode 24 and a reflection phase of unit cell 21.

As shown in FIG. 15, to achieve the state where unit cell 21 has a large reflection phase, i.e., a reflection phase of 140 degrees or more, diode 24 is required to have an impedance of 200Ω or less. In other words, when a forward bias is applied to diode 24 through the microwave supplied into heating chamber 20 and then switch 12 turns into a short-circuiting state, diode 24 is required to have an impedance of 200Ω or less.

To achieve the state where unit cell 21 has a small reflection phase, i.e., a reflection phase of 40 degrees or less, diode 24 is required to have an impedance of 800Ω or more. In other words, when a reverse bias is applied to diode 24 through the microwave supplied into heating chamber 20 and then switch 12 turns into an open state, diode 24 is required to have an impedance of 800Ω or more.

Referring to FIG. 15, diode 24 to be adopted is required to have an impedance of 200Ω or less when a forward bias is applied thereto through the microwave, and required to have an impedance of 800Ω or more when a reverse bias is applied thereto through the microwave.

Figure 16:
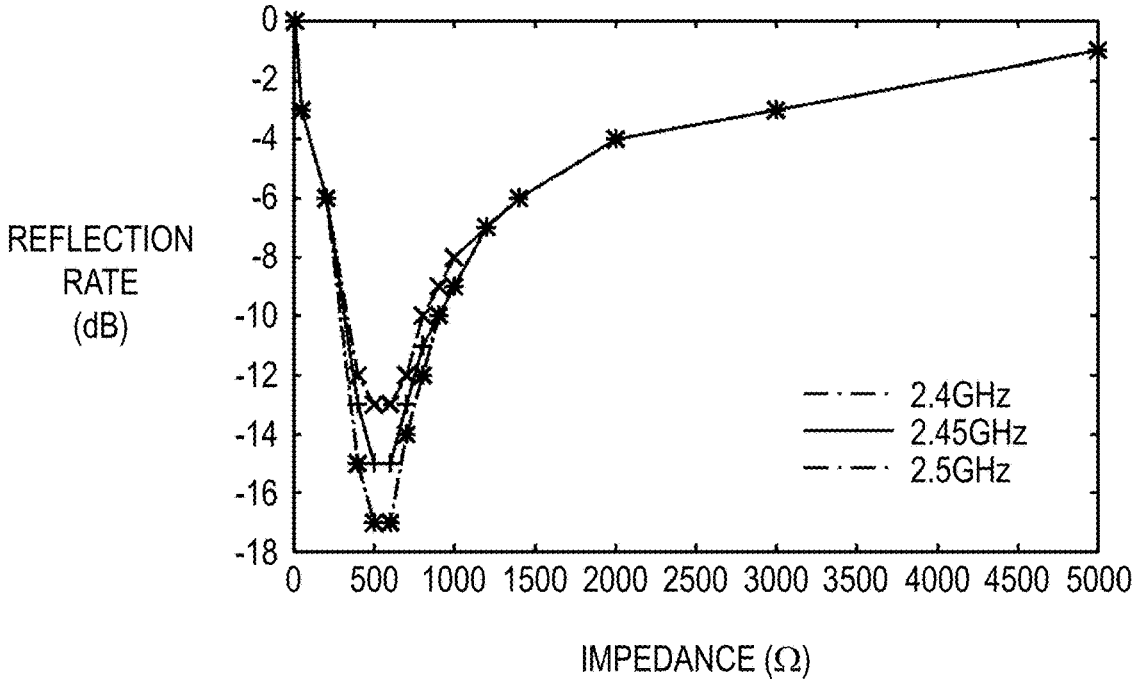
FIG. 16 is a characteristic diagram showing a relationship between a diode impedance and a reflection rate of a microwave.

FIG. 16 is a characteristic diagram showing a relationship between an impedance of diode 24 and a rate of reflection to incidence of the microwave in unit cell 21. Not-reflected microwaves become a loss. Therefore, diode 24 is desirably selected to reflect as much microwave as possible.

In the present exemplary embodiment, the selection criteria of diode 24 is to reflect more than or equal to one half of the incident microwave, i.e., have a reflection rate of more than −3 dB.

With reference to FIG. 16, it is desired that diode 24, which is to be adopted, has an impedance of 50Ω or less when a forward bias is applied thereto through the microwave, and has an impedance of 3 kΩ or more when a reverse bias is applied thereto through the microwave.

Figure 17:
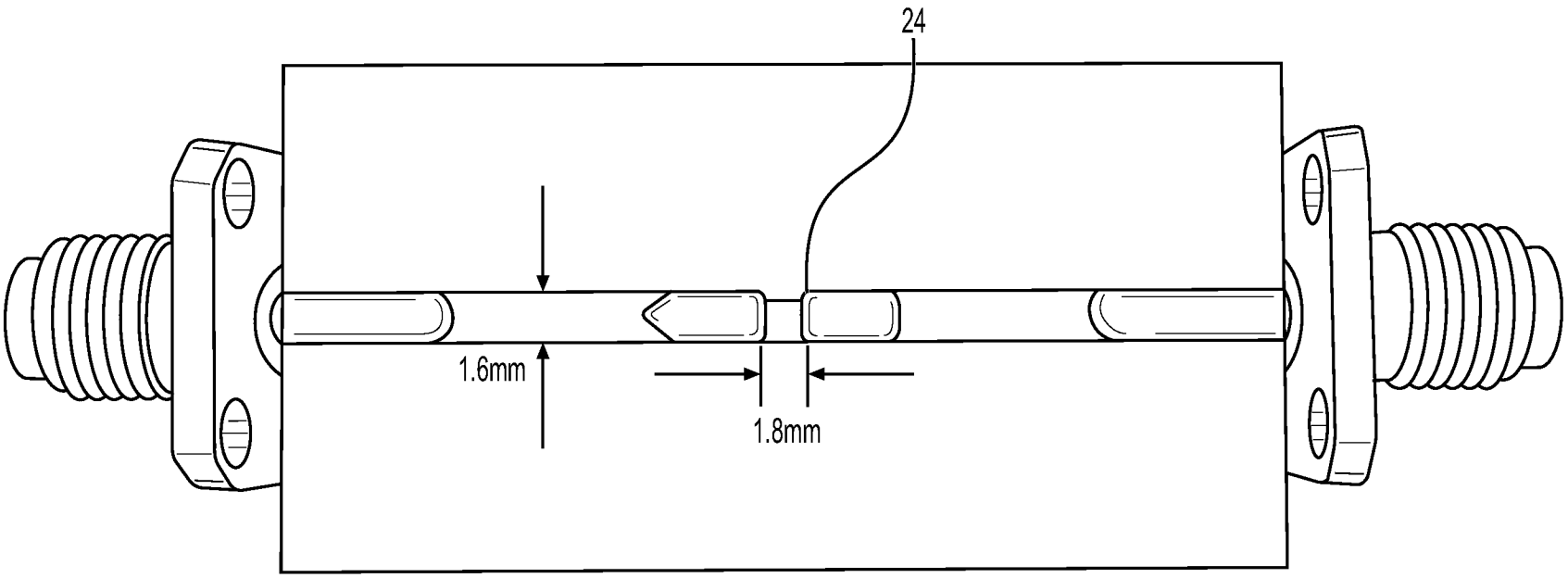
FIG. 17 is a view showing a diode connected to a microstrip line used for characteristic measurement.

FIG. 17 shows the state where diode 24, which satisfies the above-mentioned condition, is connected to a microstrip line with a width of 1.6 mm. The microstrip line is used for characteristic measurement. As shown in FIG. 17, diode 24 has a package with a length of 1.8 mm, which is quite small compared with conductor part 23 with a width of 5 mm (see FIG. 8). For this reason, the characteristics of unit cell 21 are not affected by diode 24, adversely.

Figure 18A:
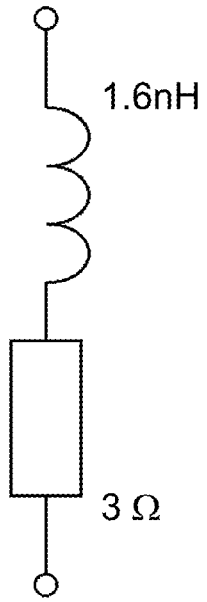
FIG. 18A is a block diagram showing an equivalent circuit of the diode when a forward bias is applied thereto.
Figure 18B:
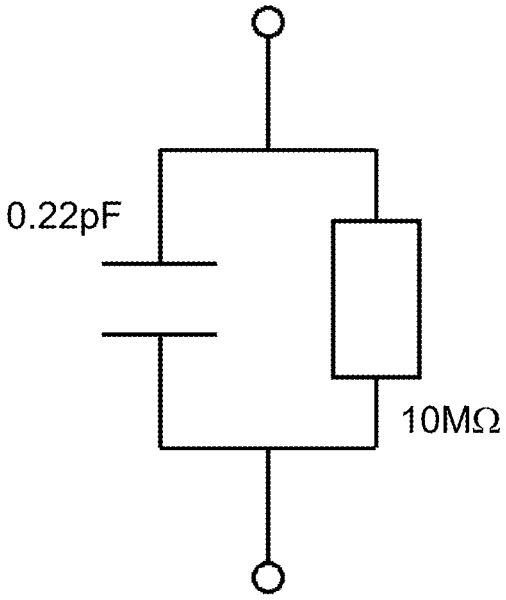
FIG. 18B is a block diagram showing an equivalent circuit of the diode when a reverse bias is applied thereto.

FIG. 18A shows an equivalent circuit of diode 24 when a forward bias is applied thereto through the microwave, and FIG. 18B shows an equivalent circuit of diode 24 when a reverse bias is applied thereto through the microwave.

As shown in FIG. 18A, the equivalent circuit of diode 24 when forwardly biased is a series circuit constituted by a resister with a resistance of approximately 3Ω and a inductor with an inductance of approximately 1.6 nH. As shown in FIG. 18B, the equivalent circuit of diode 24 when reversely biased is a parallel circuit constituted by a resistor with a resistance of approximately 10 MΩ and a capacitor with a capacitance of approximately 0.22 pF.

Figure 19:
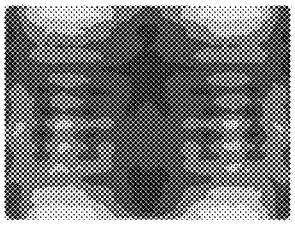
FIG. 19 is a view showing simulation results of electric field distributions generated on an object to be heated, when the equivalent circuit of the diode shown in FIG. 18A is used.
Figure 19:
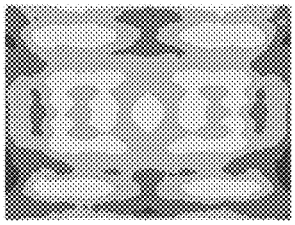
Figure 19:
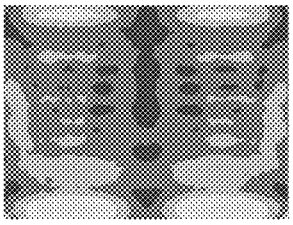
Figure 19:
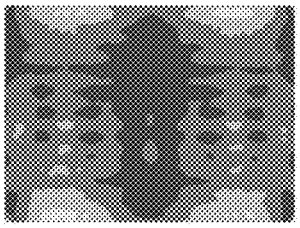
Figure 19:
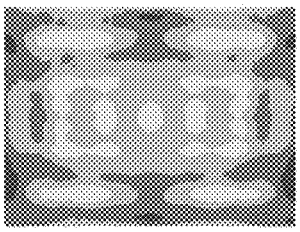
Figure 19:
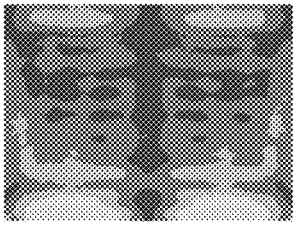
Figure 19:
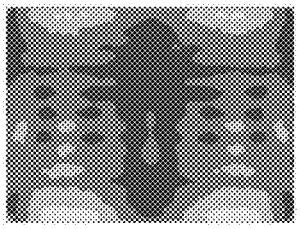
Figure 19:
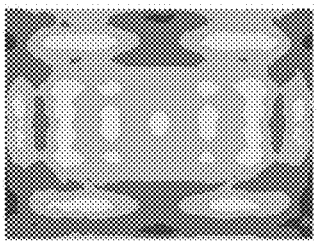
Figure 19:
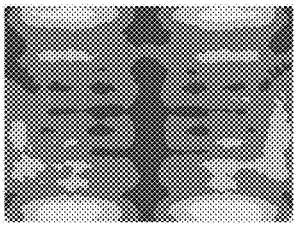

FIG. 19 shows simulation results of temperature distributions generated on object 6 to be heated (agar) when frequencies of the microwave and inductance values are changed. In the simulation, the diode having the equivalent circuit shown in FIG. 18A is employed.

Figure 20:
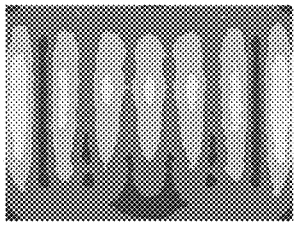
FIG. 20 is a view showing simulation results of electric field distributions generated on an object to be heated, when the equivalent circuit of the diode shown in FIG. 18B is used.
Figure 20:
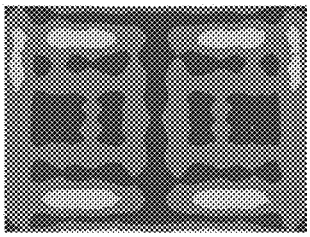
Figure 20:
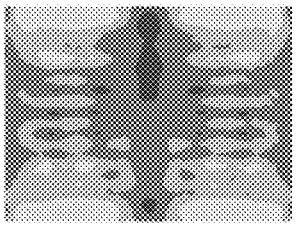
Figure 20:
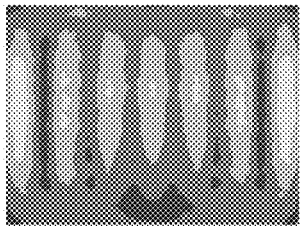
Figure 20:
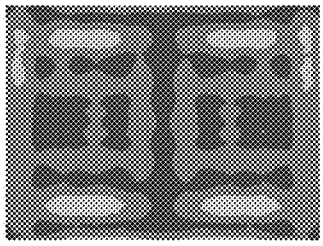
Figure 20:
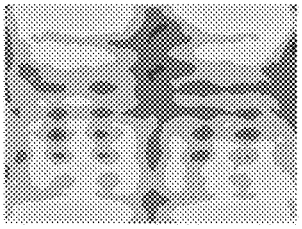
Figure 20:
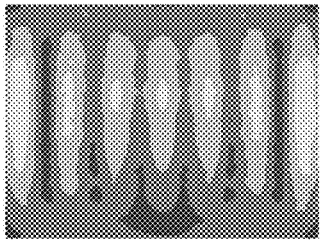
Figure 20:
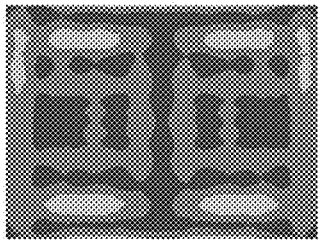
Figure 20:
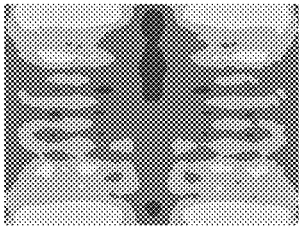

FIG. 20 shows simulation results of temperature distributions generated on object 6 to be heated when frequencies of the microwave and capacitance values are changed. In the simulation, the diode having the equivalent circuit shown in FIG. 18B is employed.

In FIGS. 19 and 20, shades of an image, which are displayed as the simulation result, indicate a temperature distribution. In other words, the temperature at a lighter color portion is higher than the temperature at a deeper color portion.

As shown in FIG. 19, when frequencies of the microwave are changed, different electric field patterns are generated on object 6 to be heated. Even when inductance values are changed, however, almost the same electric field patterns are generated on object 6 to be heated. In other words, the electric field generated on object 6 to be heated is not affected by a variation in inductance.

As shown in FIG. 20, when the frequencies of microwave are changed, different electric field patterns are generated on object 6 to be heated. Even when capacitance values are changed, however, almost the same electric field patterns are generated on object 6 to be heated. In other words, the electric field generated on object 6 to be heated is not affected by a variation in capacitance.

From the above results, to achieve electromagnetic field distribution adjustment device 5B with stable characteristics, the following conditions are required, i.e., switch 12 is constituted by diode 24 whose equivalent circuit is the series circuit shown in FIG. 18A when forwardly biased, and is the parallel circuit shown in FIG. 18B when reversely biased, for example.

According to the present exemplary embodiment, the electromagnetic field distribution is changed automatically at a portion having a strong electromagnetic field in electromagnetic field distribution adjustment device 5B. As a result, the heating distribution on object 6 to be heated is changed, thereby heating object 6 to be heated more uniformly.

According to the present exemplary embodiment, in unit cell 21 shown in FIGS. 10A and 10B, conductor part 23 and switch 12 are disposed on all sides of metal piece 11. Conductor part 23 and switch 12, however, are not necessary to provide on all sides of metal piece 11. Unit cell 21 may not have conductor part 23 and switch 12, if necessary.

In other words, electromagnetic field distribution adjustment device 5B may have unit cell 21 whose conductor part 23 and switch 12 are not provided on at least one side of metal piece 11, and unit cell 21 whose conductor part 23 and switch 12 are not provided on all sides of metal piece 11.

According to the present exemplary embodiment, electromagnetic field distribution adjustment device 5B is provided in the entire bottom face of the heating chamber. Electromagnetic field distribution adjustment device 5B, however, may not be provided in the entire bottom face of the heating chamber, if necessary.

As long as the sizes of the unit cell and metal piece 11 are determined based on the size of the diode used as switch 12, switch 12 may be connected to metal piece 11 directly, not through conductor part 23.

INDUSTRIAL APPLICABILITY

The electromagnetic field distribution adjustment device in accordance with the present disclosure is applicable for not only a microwave oven but also other heating devices using dielectric heating, such as a garbage disposal.

REFERENCE MARKS IN THE DRAWINGS

1 microwave heating device
2 and 20 heating chamber
2A and 2B virtual plane
3 microwave generator
5A and 5B electromagnetic field distribution adjustment device
6 object to be heated
7A and 7B path
11 metal piece
12 switch
13 short-circuiting conductor
14 grounding conductor
21 unit cell
22 dielectric
23 conductor part
24 diode
25 and 26 characteristic curve group

The invention claimed is:

1. An electromagnetic field distribution adjustment device comprising:

a plurality of metal pieces that are arranged to fill a predetermined two-dimensional region, the plurality of metal pieces each having a square shape or a rectangular shape;

a plurality of conductor parts, each conductor part having a square shape or a rectangular shape, wherein each metal piece of the plurality of metal pieces includes a respective conductor part of the plurality of conductor parts on each side of the metal piece which faces an adjacent one of the plurality of metal pieces, and for each side of the metal piece which faces an adjacent one of the plurality of metal pieces, the respective conductor part extends outwardly from a center portion of the side of the metal piece towards the adjacent one of the plurality of metal pieces, and wherein each conductor part is smaller than each of the metal pieces; and a switch that is provided between first and second metal pieces which are adjacent to each other among the plurality of metal pieces, wherein the switch is connected to the first and second metal pieces through the respective conductor part on a side of the first metal piece which faces a side of the second metal piece, and through the respective conductor part on the side of the second metal piece which faces the side of the first metal piece.

2. The electromagnetic field distribution adjustment device according to claim 1, wherein a distance between the first and second metal pieces is less than or equal to one half of a wavelength of a microwave.

3. The electromagnetic field distribution adjustment device according to claim 1, wherein the switch is a diode that is smaller than each of the conductor parts to which it is connected and has a breakdown voltage characteristic.

4. The electromagnetic field distribution adjustment device according to claim 3, wherein the diode has an impedance of 200Ω or less when a forward bias is applied to the diode through electromagnetic waves, and has an impedance of 800Ω or more when a reverse bias is applied to the diode through the electromagnetic waves.

5. The electromagnetic field distribution adjustment device according to claim 4, wherein when a forward bias is applied to the diode through the electromagnetic waves, an equivalent circuit of the diode is a series circuit constituted by a resistor with a resistance of 3Ω and an inductor with an inductance of 1.6 nH, and when a reverse bias is applied to the diode through the electromagnetic waves, an equivalent circuit of the diode is a parallel circuit constituted by a resistor with a resistance of 10 MΩ and a capacitor with a capacitance of 0.22 pF.

6. A microwave heating device comprising:

a heating chamber that accommodates an object to be heated;

a microwave generator that is configured to generate microwaves;

a wave guide tube that is configured to guide the microwaves to the heating chamber; and the electromagnetic field distribution adjustment device according to claim 1, wherein the electromagnetic field distribution adjustment device is provided in a two-dimensional region located in at least a part of a wall face within the heating chamber.

* * * * *